US009822964B2

(12) United States Patent
Moreau et al.

(10) Patent No.: US 9,822,964 B2
(45) Date of Patent: Nov. 21, 2017

(54) LIGHTING APPARATUS FOR A TOOL CARRIER

(71) Applicant: Ty-Flot, Inc., Manchester, NH (US)

(72) Inventors: Darrell A. Moreau, Manchester, NH (US); Andre W. Moreau, Bedford, NH (US); Reginald J. Moreau, Litchfield, NH (US)

(73) Assignee: Ty-FLOT, INC.

( * ) Notice: Subject to any disclaimer, the term of this patent is extended or adjusted under 35 U.S.C. 154(b) by 104 days.

(21) Appl. No.: 15/130,411

(22) Filed: Apr. 15, 2016

(65) Prior Publication Data

US 2016/0305648 A1 Oct. 20, 2016

Related U.S. Application Data

(63) Continuation-in-part of application No. 29/538,182, filed on Sep. 1, 2015, now Pat. No. Des. 755,376.

(60) Provisional application No. 62/148,210, filed on Apr. 16, 2015.

(51) Int. Cl.

| | |
|---|---|
| ***A45C 15/06*** | (2006.01) |
| ***F21V 33/00*** | (2006.01) |
| ***F21S 4/28*** | (2016.01) |
| ***F21V 23/04*** | (2006.01) |
| ***F21L 4/00*** | (2006.01) |
| ***F21S 4/22*** | (2016.01) |
| *F21V 23/02* | (2006.01) |
| *F21Y 115/10* | (2016.01) |
| *F21Y 103/33* | (2016.01) |

(52) U.S. Cl.

CPC ..... *F21V 33/0084* (2013.01); *F21L 4/00* (2013.01); *F21S 4/22* (2016.01); *F21S 4/28* (2016.01); *F21V 23/0442* (2013.01); *F21V 23/02* (2013.01); *F21Y 2103/33* (2016.08); *F21Y 2115/10* (2016.08)

(58) Field of Classification Search

CPC ..... F21V 33/0084; A45C 15/06

USPC ..... 362/156

See application file for complete search history.

(56) References Cited

U.S. PATENT DOCUMENTS

| | | | | | |
|---|---|---|---|---|---|
| 5,067,063 | A * | 11/1991 | Granneman | A45C 15/06 | 362/156 |
| 5,073,844 | A * | 12/1991 | Coyner | A45C 15/06 | 362/156 |
| 5,134,551 | A * | 7/1992 | Stelzer | A45C 15/06 | 362/156 |
| 5,908,232 | A * | 6/1999 | Burns | A45C 15/06 | 362/155 |
| 6,431,724 | B1 * | 8/2002 | Tedham | A45C 15/06 | 362/103 |
| 9,101,190 | B2 * | 8/2015 | Noble | F21V 33/0084 | |
| 2016/0053987 | A1 * | 2/2016 | Hsu | F21V 23/04 | 206/372 |

(Continued)

FOREIGN PATENT DOCUMENTS

CN 201958031 U * 9/2011

*Primary Examiner* — Christopher Raabe

(74) *Attorney, Agent, or Firm* — Sarita L. Pickett, Esq.

(57) ABSTRACT

A lighting apparatus for use in a tool carrier includes a conduit made of a translucent material. The conduit defines a conduit path sized to extend along a perimeter of a tool carrier floor. Light sources are disposed in the conduit and are electrically connected to a power source retained by the tool carrier. The lighting apparatus provides light to the inside of the tool carrier.

14 Claims, 4 Drawing Sheets

(56) References Cited

U.S. PATENT DOCUMENTS

| | | | | |
|---|---|---|---|---|
| 2016/0084492 | A1* | 3/2016 | Voskanian | A45C 15/06<br>362/555 |
| 2016/0157575 | A1* | 6/2016 | Britten | A45C 1/02<br>362/156 |

* cited by examiner

LIGHTING APPARATUS FOR A TOOL CARRIER

BACKGROUND OF THE INVENTION

1. Field of the Invention

The present invention relates generally to accessories for tool boxes and tool bags. Particularly, the present invention relates to lighting accessories for a tool carrier.

2. Description of the Prior Art

Persons engaged in repair and construction type work ordinarily have to use a variety of hand tools to perform tasks. The worker often stores tools in a tool carrier, such as a tool bag, bucket, or tool box. In some cases, the tool carrier is a soft-sided tool bag with a flat bottom and soft, resilient or somewhat rigid sidewall. This type of tool bag is similar in shape to a 5-gallon plastic bucket commonly used in construction.

When tools are crowded into a tool carrier, it is often difficult to see the contents near the bottom of the tool carrier. The geometry of the carrier and the tool carrier being filled with tools allows only small amounts of light to reach the bottom of the carrier. To make matters worse, some tool carriers have a dark-colored finish material that absorbs light and many hand tools have a black grip or black finish. For example, one tool carrier available in the marketplace is a vinyl tool bucket with a carrying strap equipped with a carabiner. The tool bucket is finished in black vinyl and the straps and hardware have a black finish. One variation of the bucket includes a flexible vinyl neck portion at the top of the bucket that can be drawn closed. With the bucket open, the black vinyl finish and depth of the bucket result in a very dark space at the bottom of the bucket where it is difficult to see contents.

One approach to address this problem has been for the user to illuminate the inside of the tool carrier with a hand-held flashlight or headlight. Another approach has been to position the tool carrier so that light enters the bucket and illuminates the inside of the carrier. Yet another approach has been to clip onto the rim of the tool carrier a battery-powered light source, such as one having a flexible neck that can reach into the tool carrier. With such a light, the user switches on the light as needed and positions the light source to direct light into the inside of the carrier.

SUMMARY OF THE INVENTION

Unfortunately, the lighting solutions of the prior art fail to adequately address the difficulties of lighting a tool carrier loaded with tools. In particular, ambient light entering a tool carrier from above often does not reach the contents at the bottom of the carrier because it is blocked by the carrier itself and by its contents. Also, due to the dark-colored finish materials, light does not reflect off of inside surfaces of the carrier to illuminate the bottom of the carrier. Further, the flexible sidewall of some tool carriers folds or collapses on itself during use to result in a serpentine path for light to reach the bottom of the carrier. When the carrier is finished in black or dark colors, the sidewall absorbs light rather than reflecting it towards the bottom of the tool carrier.

Thus, it is common that even a bright flashlight or headlight will not sufficiently illuminate a tool carrier so that a worker can find smaller parts or tools at the bottom of the carrier. Additionally, even when a flashlight or headlight does shine into the tool carrier, the light from the flashlight or headlight is often blocked when the user's hand or arm reaches into the tool carrier, resulting again in a poorly illuminated or non-illuminated area of the tool carrier.

Therefore, what is needed is a lighting apparatus that illuminates the tool carrier from the inside and is sufficiently rugged to be used in a tool carrier filled with hand tools and the like. Accordingly, it is an object of the present invention to provide a lighting apparatus that illuminates the inside of a tool carrier. The present invention achieves these and other objectives by providing a combination of a tool carrier and a lighting apparatus for the tool carrier.

One aspect of the invention is directed to the combination of a tool carrier and a lighting apparatus for the tool carrier. In one embodiment, the conduit is constructed for removable installation in the tool carrier. In other embodiments, the conduit is being fixedly secured in the tool carrier as a permanent part of the tool carrier.

In one embodiment, the tool carrier had a floor and one or more sidewall extending upwardly from the horizontal floor to a carrier mouth, rim, or opening. A conduit made of a translucent or transparent material defines a conduit path between a first conduit end and a second conduit end. The conduit has a conduit path sized and shaped to extend along an inside perimeter of or across the floor of the tool carrier. Light sources are disposed in the conduit and distributed along the conduit path. A power source retained by the tool carrier is electrically coupled to the light sources.

In one embodiment, the lighting apparatus is built into or connected to the tool carrier. For example, the tool carrier is tool bag made of a pliable material. The conduit includes a flexible portion attached to and extending along the tool carrier sidewall to protect electrical leads connecting the power source and the light sources. The conduit is removable in some embodiments.

In another embodiment, an openable sleeve is installed over an end portion of the conduit and defines a compartment sized to retain the power source. For example, the openable sleeve is connected between the first conduit end and the second conduit end. In one embodiment, the openable sleeve is made of neoprene rubber or other pliable material and includes a hook-and-loop closure for access to the power source.

In another embodiment, the conduit includes a sidewall conduit extending upward along the sidewall of the tool carrier and having a lower end portion connected to the conduit. Electrical leads extend through the sidewall conduit to the light sources.

In another embodiment, the conduit includes a lighting floor member joined or directly connected to the conduit and extending across the floor of the tool carrier. For example, the lighting floor member is made of a material sufficiently translucent to diffuse light transverse to the lighting floor member. At least some of the light sources direct light into a perimeter edge of the lighting floor member to illuminate the lighting floor member.

In one embodiment, the conduit is made of crosslinked polyethylene tubing with an outer diameter of about ½ inch. In one embodiment, the light sources are LEDs on a length of LED strip lighting.

In some embodiments, the floor of the tool carrier has a circular shape. For example, the tool carrier is a plastic tool bucket or cylindrical tool bag made of a pliable material.

In another embodiment, a switch is operable on the tool carrier sidewall and is electrically coupled between the light sources and the power source. In another embodiment, the switch is a sensor switch operable between an off condition and an on condition in response to a stimulus such as a vibration, a change in lighting intensity, a detected motion inside the tool carrier, and a change in conductance, resistance or other electrical property. In another embodiment, the switch includes a timer circuit causing the switch to remain in an on condition for a predetermined length of time after being changed to the on condition from an off condition.

DETAILED DESCRIPTION

Figure 1:
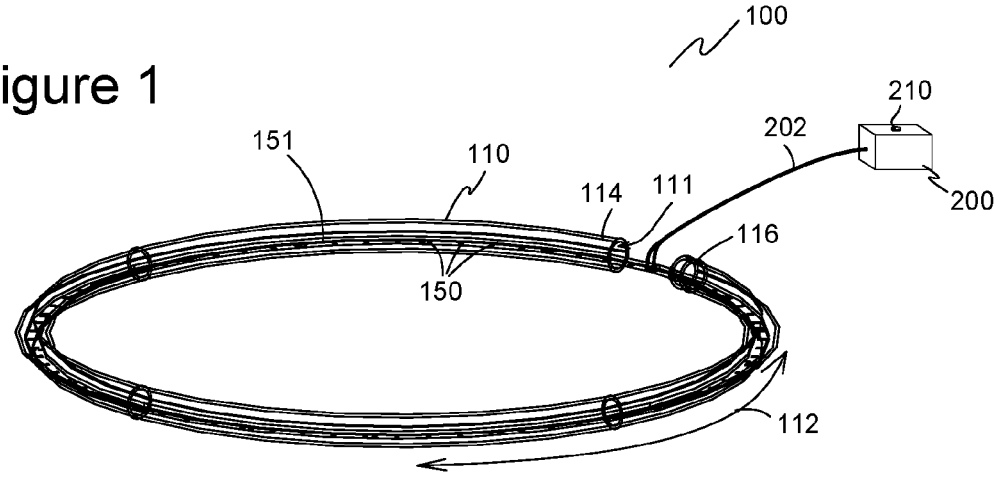
FIG. 1 is a perspective view of one embodiment of a lighting apparatus of the present invention showing a conduit with light sources and a power source connected to the light sources.

Embodiments of the present invention are illustrated in FIGS. 1-8. FIG. 1 illustrates a perspective view of one embodiment of a lighting apparatus 100 that includes a length of conduit 110, a plurality of light sources 150 disposed in a conduit opening 111 defined within conduit 110, and a power source 200 connected to light sources 150. Conduit 110 is made of a clear or translucent material and extends along a conduit path 112 between a first conduit end 114 and a second conduit end 116. In one embodiment, conduit path 112 defines a closed geometry, such as a circle, rectangle, or other shape. In other embodiments, conduit path 112 defines an open geometry, such as an arc (e.g., a C-shape) a line, a polyline (e.g., an N, U, J, or L shape) or other geometric or irregular shape where first conduit end 114 is not connected to second conduit end 116. As shown in FIG. 1, conduit 110 has a ring shape with discontinuous conduit ends 114, 116.

In one embodiment, conduit 110 is a length of cross-linked polyethylene ("PEX") tubing with a round cross-sectional shape, an inner diameter of about ⅜" (~9.5 mm) and an outer diameter of about ½" (~12.7 mm). PEX tubing is durable to provide protection to light sources 150 disposed in the tubing from the impact of tools or other objects dropped into a tool carrier, such as a tool bag or tool box, where lighting apparatus 100 is placed. Other materials and cross-sectional shapes of conduit 110 are acceptable. Acceptable materials include, for example, plastic or rubber such as clear silicone rubber, translucent polypropylene, and clear PVC. Acceptable cross-sectional shapes include round, square, rectangular, D-shape, and other shapes that define pathway 111 within the conduit of sufficient size to receive light sources 150. The material and cross-sectional shape may be selected based on the flexibility, durability, shaping ability, and translucence sought for a particular use.

In some embodiments, conduit 110 is a two-part conduit with a first conduit portion (e.g., a U-shaped portion) and a second conduit portion (e.g., a flat or U-shaped second portion), where first conduit portion mates with and combines with the second conduit portion to form a closed or substantially closed conduit 110. Examples of a two-part conduit include those used for cable and wire management, such as a hinged, rectangular raceway conduit or a corner race conduit with an L-shaped portion and an arced cover portion that attaches to the L-shaped portion.

In one embodiment, conduit 110 is formed, bent, assembled, or otherwise shaped so that conduit path 112 substantially follows a perimeter of a tool carrier floor 302 (shown in FIG. 8), such as, for example, the bottom of a tool bag, bucket, or tool box. When PEX tubing is used for conduit 110, for example, the PEX tubing is heated and then bent while hot to define conduit path 12 having the desired shape. After bending the PEX tubing, it is quenched to cool the tubing and retain the desired shape. In other embodiments, conduit 110 is assembled from a selection of parts to form the desired shape of conduit path 112, where the parts may include straight sections, corners, elbows, curves, angles, unions, and the like.

Power source 200 provides electrical power to light sources 150. Power source may be a battery, battery pack, solar panel, or other AC or DC power source appropriate for light sources 150. Power source 200 is electrically connected to light sources 150 by one or more wires 202. In one embodiment, power source 200 is a 12V power source provided by one or more batteries. In another embodiment, power source 200 is an inductive power supply connected by coupling to the plurality of light sources 150. Power source 200 may be located outside of conduit 110 or may be disposed inside conduit 110.

Optionally, a switch 210 is connected between power source 200 and light sources 150. Switch 210 may be, for example, a toggle, rocker, plunger, push-button or other mechanically-operated switch; a sensor-controlled switch that opens and closes a circuit in response to detecting motion, vibration, light, a particular sound (e.g., a voice command, series of claps, or other repeatable sound), or a change in conductance, resistance, or other electrical property; or other switch. In one embodiment, switch 210 includes timer circuitry (not shown) so that light sources 150 illuminate for a predetermined length of time in response to activation by the user and/or sensing a condition. Of course, timer circuitry may be separate from switch 210 and connected as part of a circuit with light sources 150 and power supply 200. In yet another embodiment, switch 210 is a rollerball plunger switch. For example, a rollerball plunger-type switch 210 is installed in floor 302 of tool carrier 300 (shown in FIG. 8) so that setting the tool carrier 300 on the ground depresses the plunger and closes switch 210.

In one embodiment, for example, power source 200 is a battery pack that is attached to or retained in a pocket or pouch on a tool bag with switch 210 on the battery pack or attached to the tool bag. In another embodiment, power source 200 is a plurality of watch batteries contained in conduit 110 and connected to switch 210 including a sensor. For example, switch 210 opens and closes in response to the user opening the tool carrier 300 or accessing the interior of the tool carrier 300. In one embodiment, tool carrier 300 includes a conductive fabric 317 (shown in FIG. 8) connected to switch 210 and capable of sensing a change in conductance. In such an embodiment, conductive fabric 317 acts as a touch pad for the user to turn light sources 150 on and off by making contact with conductive fabric 317.

For example, when the user opens tool carrier 300 (shown in FIG. 8) to access tools, a length of conductive fabric 317 along or adjacent rim 318 of tool carrier 300 is connected to switch 210. When the user's skin or conductive material in a glove touches the conductive fabric 317, the conductance, resistance, or other electrical property changes and is used to close switch 210, thereby completing the circuit and illuminating light sources 150. In one embodiment, switch 210 closes for a pre-defined length of time (e.g., 2 minutes) after initial contact by the user. After the pre-defined length of time expires, switch 210 opens, thereby disconnecting light sources 150 from power source 200. In other embodiments, switch 210 closes and remains closed only while the user maintains contact with conductive fabric 317.

Figure 2:
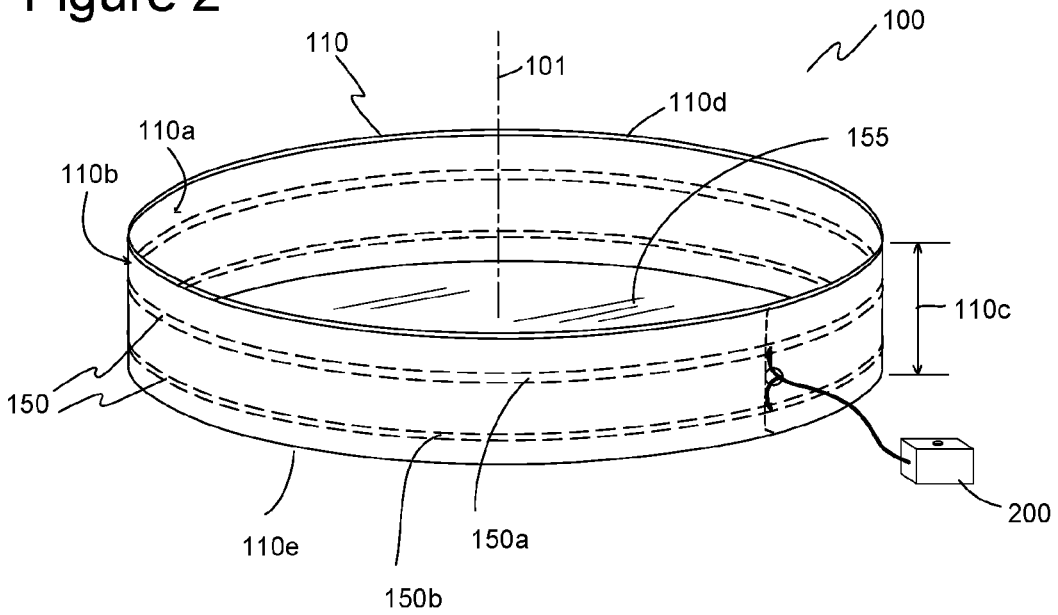
FIG. 2 is a perspective view of another embodiment of a lighting apparatus of the present invention showing a conduit with a hoop shape and an optional lighting floor member that extends across the region enclosed by the hoop-shaped conduit.

Turning now to FIG. 2, another embodiment of lighting apparatus 100 is shown. In this embodiment, conduit 110 has a hoop shape with a vertical, elongated cross-sectional shape, such as a rectangle or elongated oval. An inner face 110*a* and an outer face 110*b* of conduit 110 are substantially flat and extend generally parallel to a central axis 101. When conduit 110 is positioned in the bottom of a tool bag with conduit 110 extending along the perimeter 304 of the bag's floor 302 (shown in FIG. 8), for example, outer face 110*b* may be positioned to abut the tool bag sidewall 306. When conduit 110 has a narrow profile, it occupies a small amount of space in the tool bag.

Similar to the embodiment of FIG. 1, lighting apparatus 100 of FIG. 2 includes a plurality of light sources 150 disposed in conduit 110. In one embodiment, conduit 110 includes two or more pluralities of light sources 150, such as first light sources 150*a* and second light sources 150*b*. In one embodiment, first and second light sources 150*a*, 150*b* are spaced apart from each other within hoop height 110*c* of conduit 110 and extend circumferentially around hoop-shaped conduit 110. In another embodiment, light sources 150 (e.g., a length of LED strip lighting 151) has a plurality of coils through conduit 110.

One embodiment of conduit 110 is optionally attached to, formed with, or otherwise includes a lighting floor member 155 that extends across a region enclosed or substantially enclosed by conduit 110. In some embodiments, lighting floor member 155 is attached to and extends across a top end portion 110*d* or bottom end portion 110*e* of conduit 110. When attached to top end portion 110*d*, lighting floor member 155 provides a protective cover plate; when attached to bottom end portion 110*e*, lighting floor member 155 provides a bottom plate that may function both as a tray to catch small objects as well as providing a protective surface for the tool bag. When attached to conduit 110 at a location between top end portion 110*d* and bottom end portion 110*e*, lighting floor member 155 can serve both of these purposes. Also, when attached to conduit 110 between top end portion 110*d* and bottom end portion 110*e* and made of a translucent material, lighting floor member 155 can be illuminated by light sources 150. Lighting floor member 155 additionally is useful to provide structural support to conduit 110 to maintain its shape.

In one embodiment, for example, lighting floor member 155 connects to bottom end portion 110*e* of conduit 110 and extends across the region enclosed by or substantially enclosed by conduit 110 as illustrated in FIG. 2. For example, when conduit 110 defines a circle, lighting floor member 155 occupies the inside of the circle as a disk. Optionally, lighting floor member 155 is annular, a rectangular frame with an opening, or other shape that defines an opening. In one embodiment, conduit 110 and lighting floor member 155 are sized and structured for use as a reinforcement or base portion of a soft-sided tool carrier 300, such as a tool bag or soft-sided bucket.

Figure 2A:
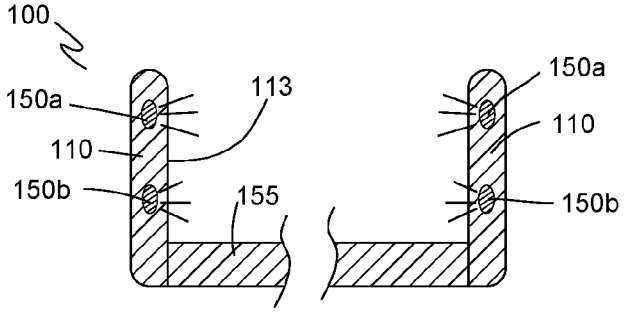
FIG. 2A is a cross sectional view of the lighting apparatus of FIG. 2 showing the lighting floor member and first and second light sources.

FIG. 2A shows a cross sectional view of one embodiment of lighting apparatus 100 with conduit 110 (e.g., hoop shaped) and lighting floor member 155 extending across the region enclosed by conduit 110. First and second light sources 150*a*, 150*b*, respectively, are retained in conduit 110 and emit light through sidewall 113 of conduit 110.

Figure 3:
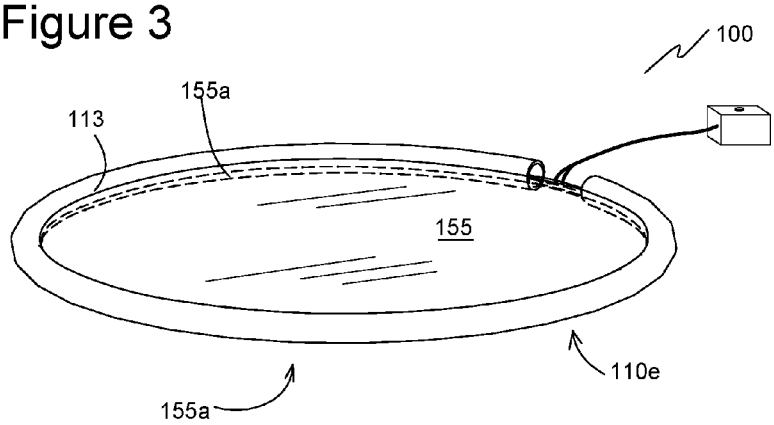
FIG. 3 is a perspective view of another embodiment of a lighting apparatus of the present invention showing an optional lighting floor member connected to a sidewall portion of the conduit and extending across the region substantially enclosed by the conduit.

Turning now to FIG. 3, a perspective view shows another embodiment of lighting apparatus 100 where conduit 110 substantially defines a closed loop. Optional lighting floor member 155 is connected or attached to a sidewall 113 of conduit 110 and extends across the region substantially enclosed by conduit 110. In some embodiments where lighting floor member 155 is connected to sidewall 113 of conduit 110, lighting floor member 155 is translucent and functions as a light guide to direct light from light sources 150 located in conduit 110 into lighting floor member 155 to further illuminate the bottom of tool carrier 300. For example, one or more light sources 150 are directed to shine light into a perimeter edge 155*a* of lighting floor member 155. Other LEDs may be directed upward or in other directions to illuminate tool carrier 300.

Figure 3A:
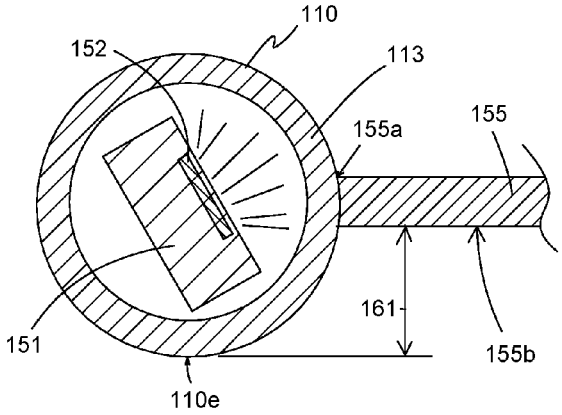
FIG. 3A is a cross-sectional view of part of a conduit and lighting floor member showing LED strip lighting within the conduit and space below the lighting floor member.

FIG. 3A shows a sectional view of part of conduit 110 with lighting floor member 155 and conduit 110. Lighting floor member 155 meets sidewall 113 of conduit 110 along a perimeter edge 155*a*. Conduit contains LED strip lighting 151 with LEDs 152 directed towards perimeter edge 155*a* of lighting floor member 155 as well as upward through conduit 110. Other orientations of LED strip lighting 151 are also acceptable, such as facing upward or facing sideways (i.e., directly towards perimeter edge 155*a*). Lighting floor member 155 optionally defines a space 161 positioned between a bottom floor face 155*b* and bottom portion 110*e* of conduit 110. Optionally, lighting floor member 155 includes a reflective bottom floor face 155*b* to reflect transmitted light up through lighting floor member 155 and into the tool carrier. Space 161 can be open or enclosed and is useful for storing power supply 200 or other components of lighting apparatus 100.

Figure 4:
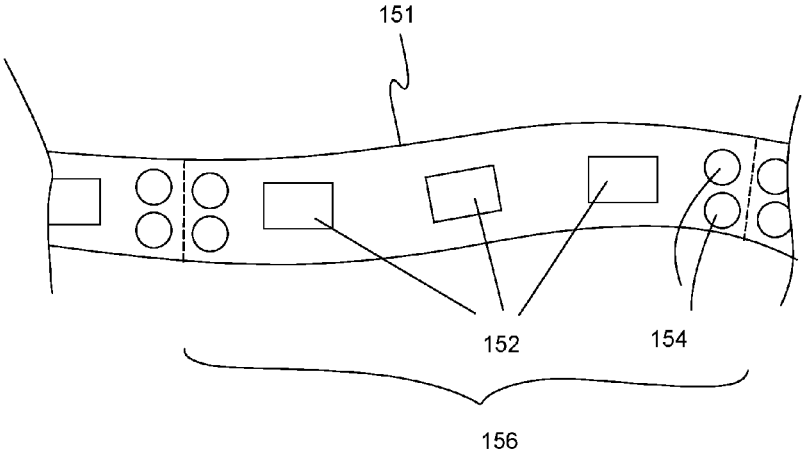
FIG. 4 is a top plan view of one embodiment of LED strip lighting that includes light sources used in embodiments of the present invention.

Turning now to FIG. 4, a top plan view shows a portion of one embodiment of LED strip lighting 151, also known as LED tape lighting. In one embodiment, LED strip lighting 151 is a flexible, integrated silicone-cased tape that contains LEDs 152, electrical contacts 154, and other circuit components (not shown) disposed in repeating groups 156. LED strip lighting 151 in some embodiments is dimmable and operates using a 12 volt or 24 volt power source. In one embodiment, LED strip lighting 151 has 12 LEDs per foot, evenly spaced one inch on center. In one embodiment, the LED strip lighting 151 has a run length from about 1 foot to about 25 feet with the ability to cut the field at predefined locations positioned periodically along its length, such as at every six inches or between repeating groups 156. One such LED strip lighting 151 product is the WAC LED-TX2427-1-WT InvisiLED Pro 2 High Output LED Tape Light System; another LED strip lighting product is made by Pilot Automotive and sold, for example, as CZ-177RWK for a 12 inch LED strip. In other embodiments, light sources 150 includes a plurality of individual LEDs, incandescent bulbs, and/or other light sources 150 disposed in conduit 110 with appropriate electrical connections made thereto.

Figure 5:
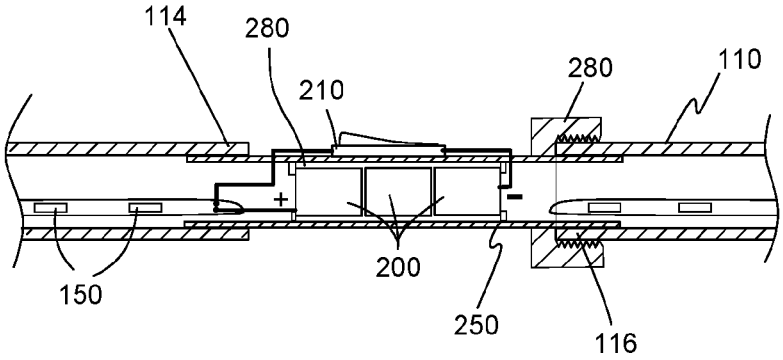
FIG. 5 is a side sectional view of a portion of one embodiment of a lighting apparatus of the present invention showing a union connector installed between conduit end portions and including a power source and a switch connected to light sources on LED strip lighting disposed in the conduit.

Turning now to FIG. 5, a side sectional view of a portion of conduit 110 is shown with an optional union connector 250 installed between and connecting first conduit end 114 and second conduit end 116. Union connector 250 may be constructed for attachment to conduit ends 114, 116 by way of a slip fit, barbed fitting, threaded coupling nut 118, compression fit, or other suitable connection. Optionally, union connector 250 defines a power source compartment 280 for power source 200. For example, one or more batteries are received in power source compartment 280 of union connector 250 for electrical connection/coupling to light sources 150. Optionally, switch 210 is built into or attached to union connector 250.

Figure 6:
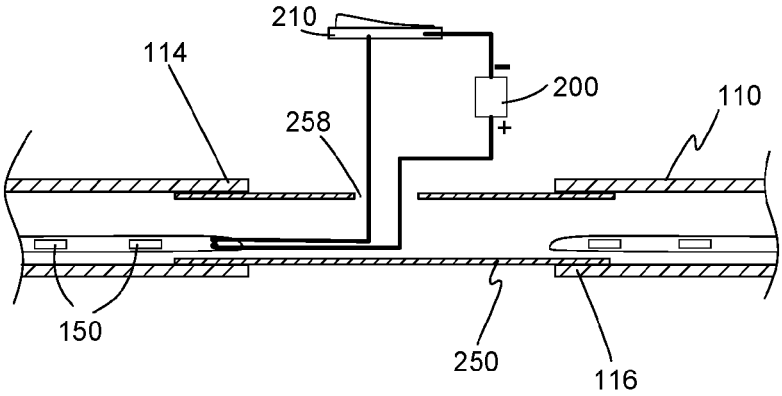
FIG. 6 is a side sectional view of a portion of another embodiment of a lighting apparatus of the present invention showing a union connector installed between conduit end portions with an opening for wires to connect between light sources inside the conduit and a switch and power source located outside the conduit.

Turning now to FIG. 6, a side sectional view of a portion of conduit 110 is shown with another embodiment of union connector 250. Union connector 250 defines an opening 258 through which wires 202 extend to connect to power source 200 and optional switch 210 located outside of conduit 110. In one embodiment, power source 200 and switch 210 are attached to or retained by the tool carrier 300, such as being retained in a pouch or attached to an outside surface.

Figure 7:
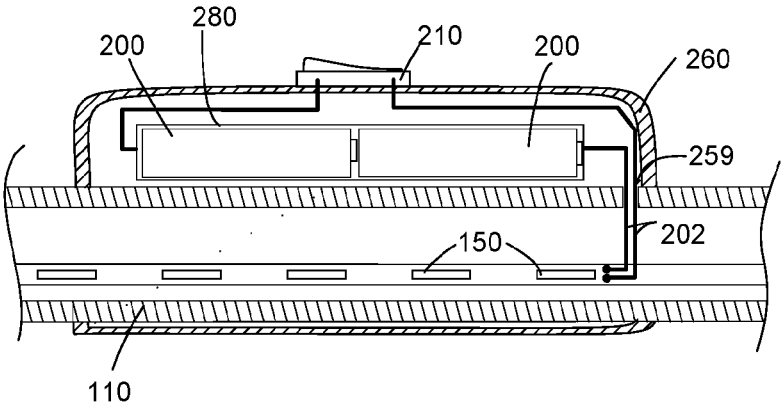
FIG. 7 is a side sectional view of a portion of another embodiment of a lighting apparatus of the present invention showing an optional sleeve disposed around the conduit, where the sleeve houses a power source and includes a switch.

Turning now to FIG. 7, a side sectional view of a portion of conduit 110 is shown with an optional sleeve 260 installed over conduit 110, where sleeve 260 defines a power source compartment 280 for power source 200. For example, sleeve 260 is made of fabric and attached around conduit 110 using hook-and-loop fasteners (not shown) so as to be openable to access power source 200 retained in sleeve 260. Other materials could be used, such as rubber, plastic, metal, materials with elastic, and neoprene. Power source compartment 280, which may include a battery holder 282, is held against conduit 110 by sleeve 260. Wires 202 extend through an opening 259 or through a conduit end 114, 116 to connect to light sources 150.

Figure 8:
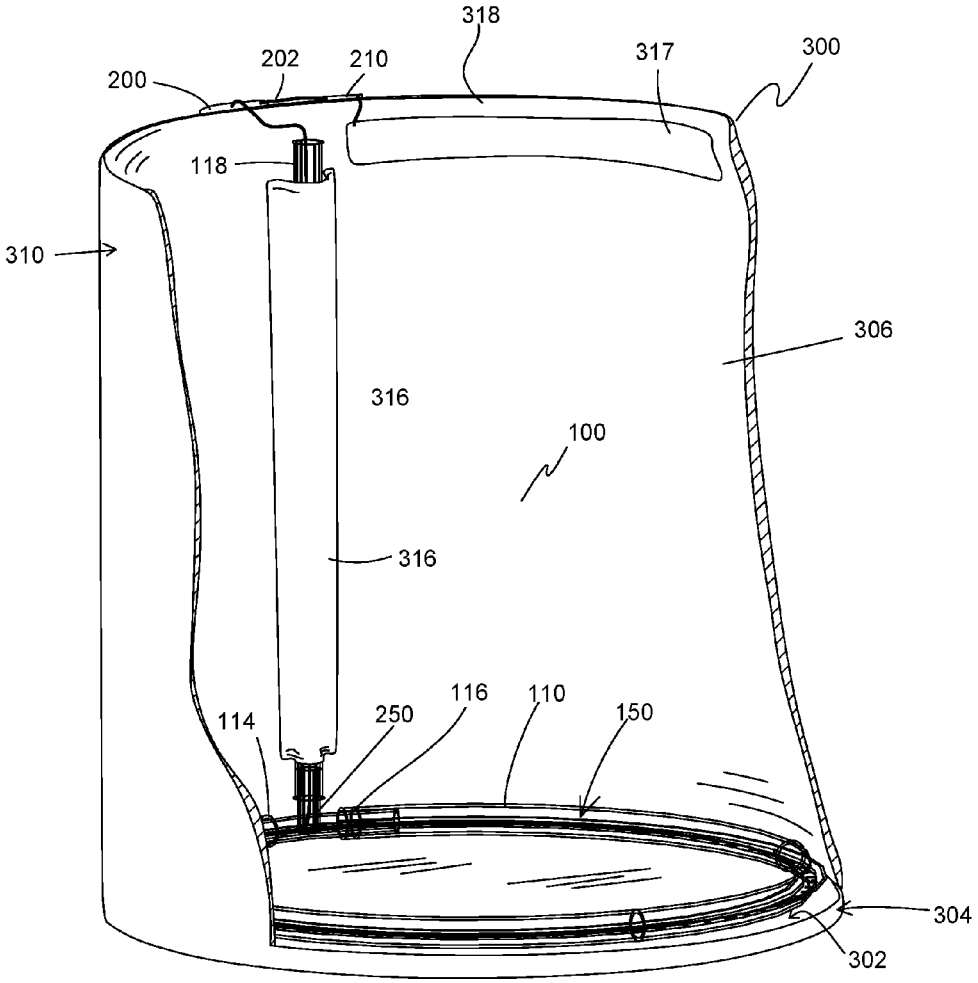
FIG. 8 is a perspective view of another embodiment of a lighting apparatus of the present invention shown in combination with a tool carrier, where the tool carrier sidewall is shown partially cut away for clarity.

Turning now to FIG. 8, another embodiment of lighting apparatus 100 is shown installed in a tool carrier 300 with part of sidewall 306 cutaway for clarity. Tool carrier 300 includes a floor 302 having a perimeter 304. A sidewall 306 extends transversely (e.g., upward) from floor 302. Floor 302 and/or sidewall 306 may be rigid or flexible. In the embodiment shown in FIG. 8, conduit 110 houses LED strip lighting 151 with light sources 150. Conduit 110 extends substantially along perimeter 304 of floor 302 to define a closed loop that is completed with a union connector 250 installed between and connecting first conduit end 114 and second conduit end 116. In one embodiment, union connector 250 is a T-shaped union that also connects conduit ends 114, 116 to a vertical conduit 118 extending along sidewall 306 of tool carrier 300. Vertical conduit 118 provides a protected pathway for wires 202 from light sources 150 to power source 200 and switch 210 (not visible) that may be stored, for example, in a pouch or compartment on an outside surface 310 of tool carrier 300. An optional length of conductive fabric 317 is attached to sidewall 306 adjacent rim 318 and is electrically connected to switch 210. Switch 210 includes a sensor (not visible) to detect a change in conductance when the user's skin makes contact with conductive fabric 317 and opens or closes switch 210 in response to the change in conductance.

In another embodiment, union connector 250 is a T-shaped union that directs wires 202 from conduit 110 to a sidewall conduit 316 defined in sidewall 306 or attached to sidewall 306. For example sidewall conduit 316 is defined by a fabric strip stitched to sidewall 306 and extending partially or completely along sidewall 306 from floor 203 to rim 318 of tool carrier 300. In one embodiment, sidewall conduit 316 extends part way towards rim 318 to an opening (not shown) in sidewall 306 for wires 202 to connect to power supply 200 and/or switch 210 located on outside surface 310 of tool carrier 300.

In another embodiment, wires 202 exit conduit 110 or union connector 250 and travel along sidewall 306 to power supply 200 and/or switch 210. For example, wires 202 are protected by a cavity in sidewall 306, by a sidewall conduit 316 made of fabric or pliable material, or by being stitched to sidewall 306 between power source 200, switch 210, conductive fabric 317, and or other components as needed.

In use, embodiments of lighting apparatus 100 may be installed in tool carrier 300 to illuminate the bottom of the tool carrier. When lighting apparatus 100 is separate from tool carrier 300, the user installs lighting apparatus 100 in tool carrier with conduit 110 against floor 302 of tool carrier 300, such as extending along the perimeter 304 of floor 302 and abutting sidewall 306. In some embodiments, lighting apparatus 100 is installed in a temporary or removable fashion. In other embodiments, lighting apparatus 100 is permanently or semi-permanently installed in tool carrier 300, or provided in combination with tool carrier in a pre-assembled form, such as when wires 202, power source 200, switch 210, and/or other components are attached to, extend through, or are integrally connected with tool carrier 300. When switch 210 is provided, the user closes switch 210 to turn on light sources 150 and illuminate the interior of tool carrier 300. When conductive fabric 317 is provided, the user contacts conductive fabric 317 to close switch 210 and illuminate light sources 150. Power source 200 is charged, updated, or replaced as needed to provide electrical power to light sources 150.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A combination of a tool carrier and a lighting apparatus for the tool carrier comprising:

a tool carrier having a floor and a sidewall extending upwardly from the horizontal floor to a carrier mouth;

a conduit made of a translucent or transparent material and defining a conduit path between a first conduit end and a second conduit end, wherein the conduit has a conduit path sized and shaped to extend along an inside perimeter of or across the floor of the tool carrier;

a plurality of light sources disposed in the conduit and distributed along the conduit path; and a power source retained by the tool carrier and electrically coupled to the plurality of light sources.

2. The combination of claim 1, further comprising an openable sleeve installed over an end portion of the conduit and defining a compartment sized to retain the power source.

3. The combination of claim 2, wherein the openable sleeve is connected between the first conduit end and the second conduit end.

4. The combination of claim 1 further comprising:

a sidewall conduit extending upward along the sidewall of the tool carrier and having a lower end portion connected to the conduit, wherein electrical leads extend through the sidewall conduit to the plurality of light sources.

5. The combination of claim 1 further comprising:

a lighting floor member joined to the conduit and extending across the floor of the tool carrier.

6. The combination of claim 5, wherein the lighting floor member is made of a material sufficiently translucent to diffuse light transverse to the lighting floor member, and wherein at least some of the plurality of light sources direct light into a perimeter edge of the lighting floor member to illuminate the lighting floor member.

7. The lighted tool carrier of claim 6, wherein the lighting floor member has a reflective bottom floor face.

8. The combination of claim 1, wherein the plurality of light sources is a plurality of LEDs on a length of LED strip lighting.

9. The combination of claim 1, wherein the conduit is made of crosslinked polyethylene tubing with an outer diameter of about ½ inch.

10. The combination of claim 1 further comprising a sensor switch electrically connected between the power source and the plurality of light sources, the sensor switch operable between an off position and an on position in response to a stimulus selected from the group consisting of a vibration, a change in lighting intensity, a detected motion inside the tool carrier, a change in conductance, and a change in resistance.

11. The combination of claim 10, wherein the sensor switch changes from the off position to the on position for a predefined length of time in response to the stimulus.

12. The combination of claim 1, wherein the floor shape is circular.

13. The combination of claim 1 further comprising:

a switch operable on tool carrier sidewall and electrically coupled between the plurality of light sources and the power source.

14. The combination of claim 1, wherein the conduit is removable from the tool carrier.

* * * * *